US006889920B2

(12) United States Patent
Nance et al.

(10) Patent No.: US 6,889,920 B2
(45) Date of Patent: May 10, 2005

(54) DIRECTED SPRAY MAST

(75) Inventors: Thomas A. Nance, Aiken, SC (US); Alvin A. Siddall, Aiken, SC (US); William Y. Cheng, N. Augusta, SC (US); Kevin T. Counts, Aiken, SC (US)

(73) Assignee: Westinghouse Savannah River Company, Aiken, SC (US)

( * ) Notice: Subject to any disclaimer, the term of this patent is extended or adjusted under 35 U.S.C. 154(b) by 0 days.

(21) Appl. No.: 10/800,503

(22) Filed: Mar. 15, 2004

(65) Prior Publication Data

US 2005/0045751 A1 Mar. 3, 2005

Related U.S. Application Data

(60) Provisional application No. 60/455,303, filed on Mar. 17, 2003.

(51) Int. Cl.[7] ..... B05B 15/08; B05B 15/06; B05B 9/01

(52) U.S. Cl. ..... 239/587.1; 239/280.5; 239/525; 239/532

(58) Field of Search ..... 239/280, 280.5, 239/281, 525, 532, 531, 587.1, 587.5

(56) References Cited

U.S. PATENT DOCUMENTS

| | | | | |
|---|---|---|---|---|
| 3,599,871 | A * | 8/1971 | Ruppel et al. | 239/227 |
| 4,201,597 | A | 5/1980 | Armstrong et al. | |
| 4,272,989 | A * | 6/1981 | Rymarchyk et al. | 266/78 |
| 4,690,327 | A * | 9/1987 | Takai et al. | 239/226 |
| 5,179,757 | A | 1/1993 | Grant, Jr. | |
| 5,419,922 | A * | 5/1995 | Bajek | 427/140 |
| 5,561,883 | A * | 10/1996 | Landry et al. | 15/302 |
| 5,594,973 | A | 1/1997 | Brusseleers et al. | |
| 5,740,821 | A | 4/1998 | Arnold | |

* cited by examiner

*Primary Examiner*—David A. Scherbel
*Assistant Examiner*—Seth Barney
(74) *Attorney, Agent, or Firm*—McNair Law Firm, P.A.

(57) ABSTRACT

Disclosed is an elongated, tubular, compact high pressure sprayer apparatus for insertion into an access port of vessels having contaminated interior areas that require cleaning by high pressure water spray. The invention includes a spray nozzle and a camera adjacent thereto with means for rotating and raising and lowering the nozzle so that areas identified through the camera may be cleaned with a minimum production of waste water to be removed.

5 Claims, 3 Drawing Sheets

Fig. 1A
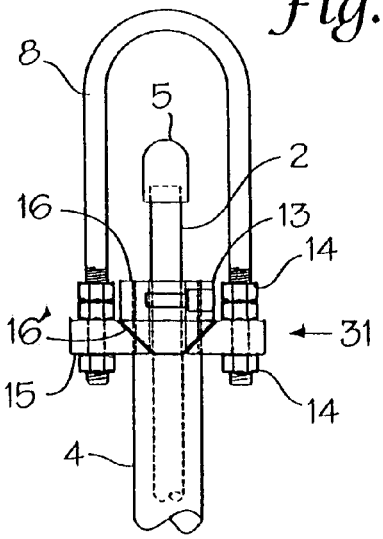
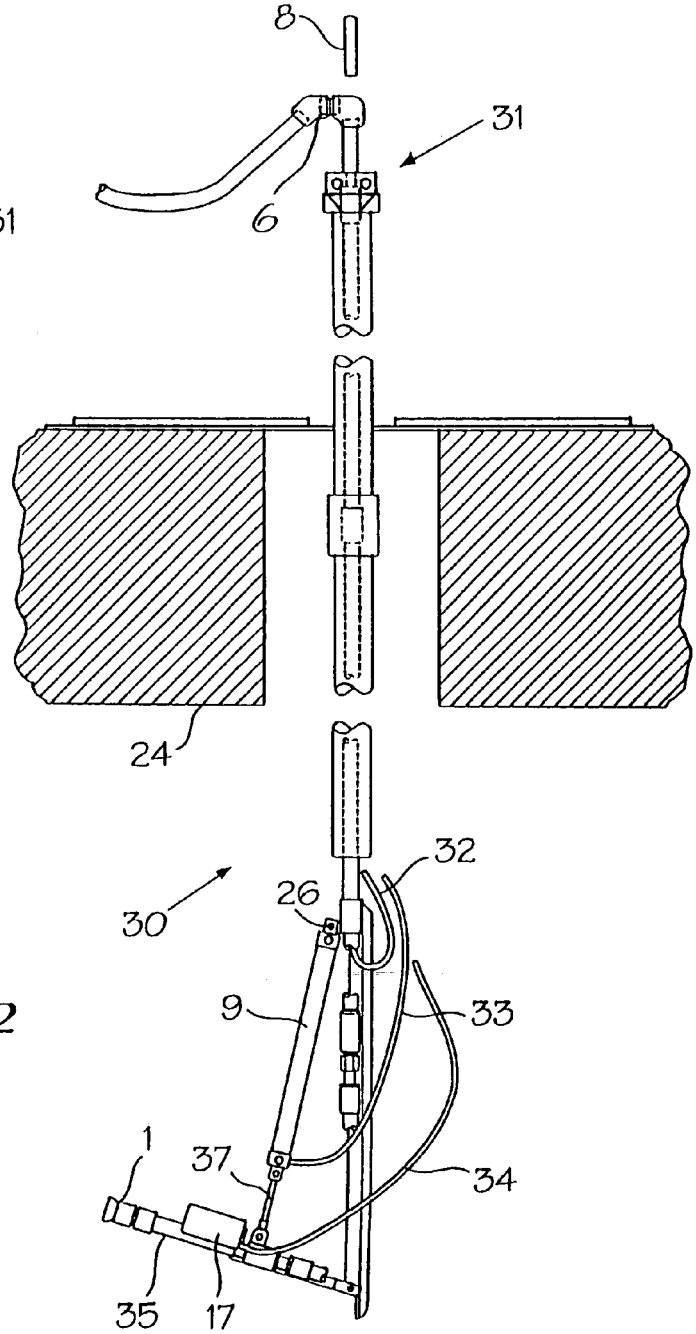
Fig. 2

DIRECTED SPRAY MAST

CROSS REFERENCE TO RELATED APPLICATION

This application claims priority of Provisional Application Ser. No. 60/455,303, filed Mar. 17, 2003.

The invention was made with Government support under Contract No. DE-AC09-96-SR18500 awarded by the United States Department of Energy. The Government has certain rights in the invention.

FIELD OF THE INVENTION

This invention relates to high pressure cleaning devices for the interiors of vessels or tanks which are used for storage or for industrial processes. More specifically, this invention relates to high pressure cleaning devices that can gain access to the interior of a vessel through a relatively narrow port and clean only identified contaminated areas so that a minimum volume of contaminated water or solvent is generated.

BACKGROUND OF THE INVENTION

In many industrial processes tanks or vessels are employed which are used either to store liquids for future use or in part of a process. Also, many types of vessels are used as the containment for a wide variety of reactions, both batch processes and continuous processes, each of which can result in deposits being made on the surfaces within the vessel. These deposits usually must be removed to preserve the integrity of subsequent use of the vessel or tank. Most often, specific areas within a reaction vessel get significantly contaminated whereas other areas may have no contamination at all. Accordingly, one general object of the present invention is to use a limited amount of water or cleaning solvent to clean only the contaminated areas so that the waste cleaning liquid generated is a relatively small quantity to be discarded.

By way of an example, and not by way of limitation of the present invention, evaporators and specifically, evaporators that are used to reduce hazardous waste such as radioactive waste to a point where it can be effectively dealt with and disposed of present unique cleaning problems. Evaporators, boilers, and heat exchange equipment almost invariably leave deposits behind that require removal.

In one process, evaporators which consist of tanks or pots with warming coils are used to heat radioactive waste liquids until the liquid separates from the solids and is evaporated whereby the remaining liquid is concentrated liquid waste. A feed tank supplies the radioactive waste liquid that is pumped into an evaporator pot and into the pot's lower section which is conically-shaped. Warming coils are located in the conical section along with a steam lance and an intake line to a separator pot. Steam is introduced at the bottom of the conical section causing a decrease in the density of the waste material at the bottom of the evaporator pot. The heavier waste material above pushes down the less dense material and the evaporator conical bottom is pushed up into the pipe to a separator pot leading to a feed tank that collects the more concentrated waste material.

The evaporators are housed in concrete boxes or cells with coils that surround the evaporators and associated jumper pipes. The cell covers are heavy concrete interlocking blocks. Access within the cell can be gained using riser ports in the cell covers that penetrate into the cell interior.

However, removal of the cell cover from the base of the cell means that the cleaning liquid which may be sprayed up against the bottom of the cell cover will have to be collected and an additional area will have to be cleaned. Also, the floor of the cell can be cleaned directly under the access ports but, here again, in prior art cleaning devices excess liquid will be used that will cover the entire floor and it must be removed from the cell. Thus, it is much more effective and safer for the covers and flooring of such cells to be cleaned in place and not moved so that the liquids to be collected are kept at a minimum and the problem of containing them is significantly reduced.

Accordingly, it is another object of the present invention to provide a means for cleaning large heavy vessels with small access ports and perform the operation so that the risk of further contamination is significantly reduced.

Not only do vessels which contain radioactive materials need periodic cleaning but so do many vessels which contain a wide variety of products ranging from fuel oil to fertilizers to food products. In U.S. Pat. No. 3,599,871 which issued on Aug. 17, 1971 to Donald B. Ruppel et al., a jet spray cleaning apparatus is disclosed which directs a high pressure stream of fluid against the interior surface of a tank that is used in chemical processing. However, the use of this cleaning apparatus requires a large man-way opening and multiple cantilevered arms which spray the entire surface inside a vessel leaving a large quantity of waste water. Thus, it is an object of the present invention to provide simplified equipment that can be inserted through small diameter access ports and direct high pressure spray at selected or identified areas within the interior of the vessel and use minimum cleaning water.

For another industry, the remotely-controlled, mounted robotic system of U.S. Pat. No. 5,740,821 which issued on Apr. 21, 1998 to Kermit R. Arnold is described for cleaning tanks used in the petrochemical oil refining industries. However, again, this device, though remotely guided, is a large cumbersome unit that can be used only where a manway is available. As stated above, a general object of the present invention is to provide a means for cleaning the interior of vessels and tanks through small access ports without large, cumbersome equipment which requires entry through manways. Other such prior art devices are disclosed in U.S. Pat. No. 4,201,597 which issued to James A. Armstrong, et al. on May 6, 1980; U.S. Pat. No. 5,179,757 which issued to Louis A. Grant, Jr. on Jan. 19, 1993; and U.S. Pat. No. 5,594,973 which issued to Joseph Brusseleers, et al. on Jan. 21, 1997.

Features of the present invention which accomplish its objects are described more fully below in the Summary of the Invention.

SUMMARY OF THE INVENTION

In one aspect the present invention is a directed spray mast that comprises a water supply pipe having an elongated support plate extending from its lower end. A pneumatically actuated support tube is pivotally fastened to the lower end of said plate. A flexible hose connects the water pipe and the support tube that has a camera and high pressure nozzle at its lower end. The support tube can be raised and lowered by the pneumatic actuator and directed by the views provided by the camera. The cable for the camera and lines for the pneumatic actuator are enclosed in a jacketing, mast support pipe surrounding the water supply pipe. At its upper end the supply pipe and support pipe terminate in a lifting bail that can be connected to a crane to raise and lower the supply pipe. The pipe can be rotated manually by turning the lift bail. When inserted in an access port contaminated areas are identified through the camera so that high pressure cleaning spray can be found on the area.

Among the features of the present invention that distinguish it over the prior art are its ability to aim and direct pressurized cleaning water at a particular location within an enclosed vessel and to remain on that location using only the water volume and pressure where it is needed whereas prior devices sweep back and forth and spray entire areas past the point that needs to be cleaned rather than concentrating on one spot.

A further and very important feature of the present invention is that it is not only compact and its jet spray is directed by a submersible camera but by the use of a pneumatic cylinder to direct the spray within the vessel, the explosion hazard presented by sparks from electrical motors and switches within a closed vessel are eliminated.

A still further advantage of the present invention is that it uses remote actuation of a short elbow of connecting hose so that the flexing required by some of the prior art devices which employ long hoses and cable linkages on the top of a tank or within a vessel is eliminated. In addition, the pneumatic tube and camera cable are enclosed within the cover or support pipe of the invention to protect them from snagging or catching on protrusions within a tank. Crushing or crimping the water or pneumatic lines or cables is prevented.

All of these features and advantages are found in the present invention which, in another aspect, is a directed spray mast for cleaning identified or selected surface areas in the interiors of closed vessels, pipes, and the like through access ports of relatively small diameters comprising: a multi-positionable, rotatable mast support pipe having upper and lower ends, said pipe having a substantially uniform diameter for insertion into an access port of a vessel to be cleaned; lift bail means for supporting and vertically and radially positioning said mast pipe by rotating same; a water supply pipe coaxially disposed within said support pipe and extending above and below said support pipe; a spray nozzle assembly pivotally mounted to a support plate carried by said water pipe at said pipe's lower end, said assembly extending with and being parallel to said support pipe in its compact, closed position; a submersible video camera mounted in said nozzle assembly; and pneumatic means having one end pivotally mounted to the said support pipe adjacent its lower end with its other end being pivotally attached to said nozzle assembly for raising and lowering the nozzle assembly in response to actuation of the pneumatic means whereby the nozzle assembly is caused to swing outwardly from said support plate to an expanded position of the spray mast and, with camera guidance, the nozzle assembly can be raised, lowered, and rotated to direct water spray to selected interior areas of the vessel to be cleaned.

The invention includes enclosing the pneumatic lines for actuating the pneumatic means and the camera cable within the support pipe to protect same and to provide for easy insertion and removal of the directed spray mast from an access port. A pneumatic pressure pump with control valves are connected to said lines as is known to those skilled in the art. Likewise, the camera cable is connected to a video display monitor and the supply pipe is connected to a controllable source of high pressure water.

Still another feature of the present invention is that the spray mast can be made in differing lengths for deep vessels or extended pipe lengths. These and other features and advantages of the invention will be appreciated from the drawings and detailed description that follow.

DESCRIPTION OF THE DRAWINGS

Appended hereto by way of illustration and not limitation are the following drawings which show a preferred embodiment of the present invention and in which:

FIG. 1*a* is a blown up section from FIG. 1 of the bail and swivel support means for the directed spray mast of the present invention;

FIG. 2 shows the spray mast of FIG. 1 with the spray mast assembly in an expanded or directed position.

DETAILED DESCRIPTION

For convenience, the embodiments and claims refer to the invention in a vertical position; but, horizontal or other positions are within the scope of the invention.

Figure 1:
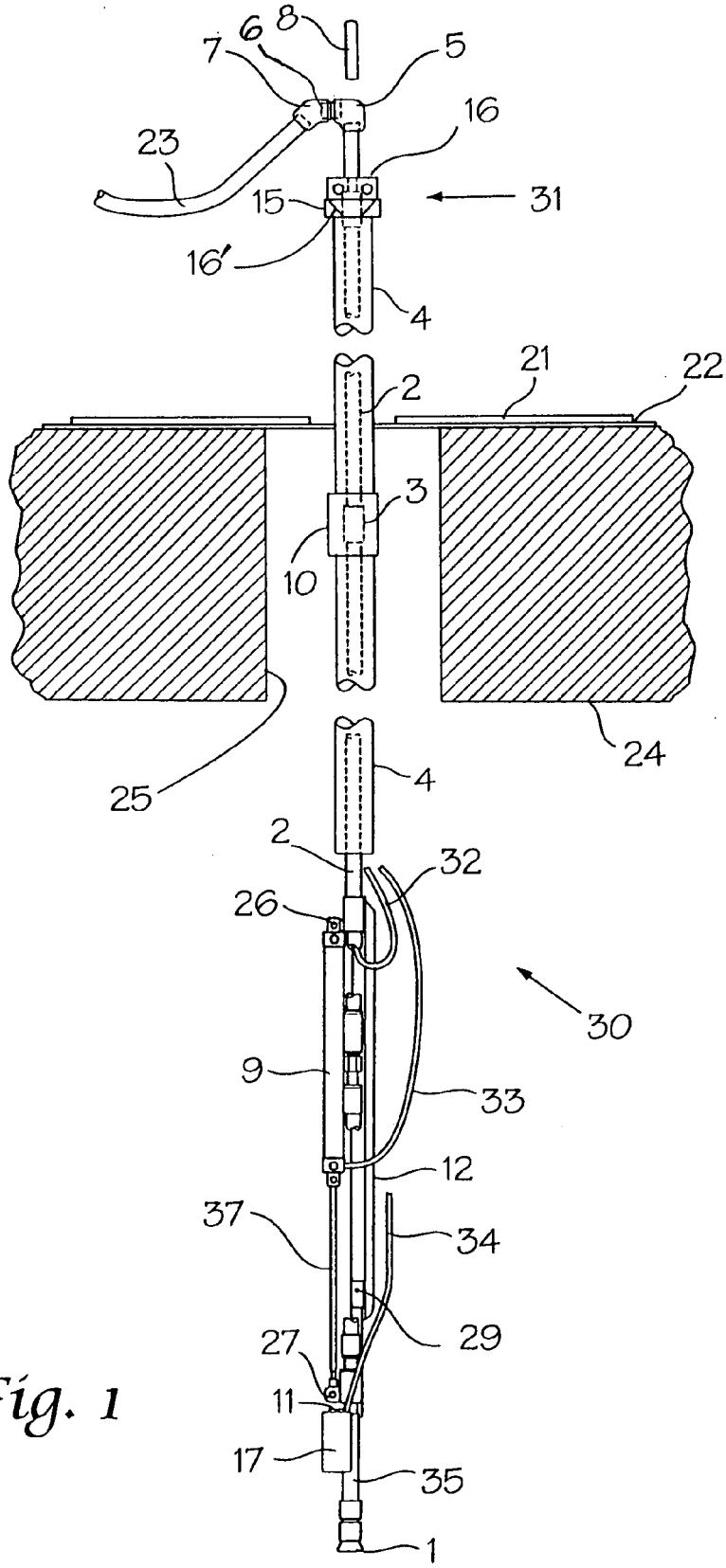
FIG. 1 is an elevation view of the directed spray mast of the present invention in its compact position mounted in the access port of a containment vessel, a segment of the wall of which is shown.

Referring first to FIGS. 1 and 1*a*, directed spray mast 30 is shown positioned in access port 25 which is formed in wall 24 of a tank or containment vessel. In this position, the mast 30 is held by the bail connector 8 (FIG. 1*a*). Conveniently, a crane may be used to raise, lower, and hold the spray mast. Cover plate 21 surrounds the mast 30 to cover the opening to the access port 25 and rubber gasket 22 is positioned around mast pipe 4 and extends outwardly as a seal between the cover plate and the vessel wall (FIG. 1. T*his*) cover plate prevents back spray from leaving the vessel during a cleaning operation.

Spray mast 30 comprises the support mast pipe 4 or the outer protective cover or jacket of the upper portion of the directed spray mast. This pipe may have a diameter of ¾" in a preferred embodiment. This allows the directed spray mast to be readily inserted into access ports having diameters as small as 2". The mast pipe and other piping and connectors described herein are preferably constructed of stainless steel, but other strong, non-corrosive metals or plastics may be used. Another advantage to the design of the spray mast and the use of stainless steel is that it can be readily cleaned itself.

Center water supply pipe 2 extends the length of the support mast pipe 4 and is a pipe which will withstand at least 3,000 psi pressure. Coupling 3 is for securing fastening extensions of the water supply pipe 2 to be added and coupling 10 allows for additional lengths of support mast pipe 4.

In the embodiment being described herein, total lengths of up to 25 and even greater than 40 feet can be accommodated at these pipe diameters. (The water supply pipe is preferably about ⅜" diameter). All of the water pipes, lines and couplings should be able to withstand 3,000 psi. Such pipes and connections are readily available and well-known to those skilled in the art.

At its upper end the support mast pipe 4 terminates in swivel assembly 31 which comprises support pipe collar 15 which is held by pressure pipe collar clamp 16. Extending through this area is the upper portion of water supply pipe 2 which terminates in elbow 5 with nipple 6 that fastens into 45° elbow 7 for high pressure water supply line or hose 23.

A high pressure pump delivers water to this line but is not shown. Such pumps are well-known in the art and pressures up to 3,000 psi are preferred for this embodiment.

Turning now specifically to FIG. 1*a*, the lift bail assembly which carries the directed spray mast and which is used for rotating the lift bail connector will be seen. The support pipe collar 15 is threaded to the support pipe at the pipe's upper end. The water supply or pressure pipe 2 is clamped by the pressure pipe clamp 13. The conical surface 16' of collar 16 is provided with orifices (not shown) so that the pneumatic lines and cable threaded through the space between the water pressure pipe 2 and support pipe 4 may exit here passing through collar 16 and be connected to air pressure and viewing screen means. Ring nuts 14 secure bail connector 8 to preserve pipe collar screw 15.

Continuing again with FIG. 1, the lower part of the directed spray mast 30 will be described. Pneumatic actuator 9 which is a push-pull pneumatic cylinder with actuating piston therein is shown with the upper supply line 32 and lower supply line 33 to push or pull the piston within the pneumatic cylinder 9. These two lines are threaded inside and protected by the support pipe 4 at the lower end of the support pipe. Likewise, camera cable 34 is connected to the camera 17 which is a submersible camera as shown here in the partial section as it is threaded above this region into the support pipe 4 for protection. Connecting rod 37 of pneumatic cylinder or actuator 9 is connected to the spray nozzle support pipe 35 at pivot 27. Camera 17 is carried on the nozzle support tube 35 beyond or below the pivot 27. (Refer to FIG. 2 to see the arrangement along the support tube 35.)

In FIG. 1 the directed spray mast 30 is shown in its compact or closed position where the spray nozzle 1 is at the extreme distal or lower end of the spray mast 30. Camera 17 is located on the support tube 35 and is held in place by the video camera screw 11.

The function of the spray nozzle assembly can be appreciated by referring to FIG. 2 where the spray mast is in expanded position so that the nozzle 1 can be directed to spray an identified area or an area which has been selected by viewing through camera 17. In this position the connecting rod 37 is withdrawn into the actuator 9 to lift the support tube 35 through the pivoted connector 27 which lifting is caused by the introduction of air through pneumatic supply line 33 into the lower portion of the cylinder 9 to force the piston upwardly and withdraw the connecting rod 37 to the position shown. In this position the bail handle 8 at the upper end of the spray mast can be rotated by guidance from the camera 17 so that the spray can be directed to any portion of the interior of the vessel 24. The pressures in the pneumatic supply lines 32 and 33 are controlled to change the angle of the support tube 35 and nozzle 1 as can be directed by viewing through the camera 17. In this manner a contaminated or soiled area of the interior of the pressure vessel can be identified and only enough high pressure water spray need be used to remove the contaminants. By so controlling the direction of the spray the amount of contaminated water that must be disposed of after a cleaning operation is limited because the operator can periodically stop the flow, observe the progress of the cleaning and then determine if additional cleaning and water must be used.

Figure 3:
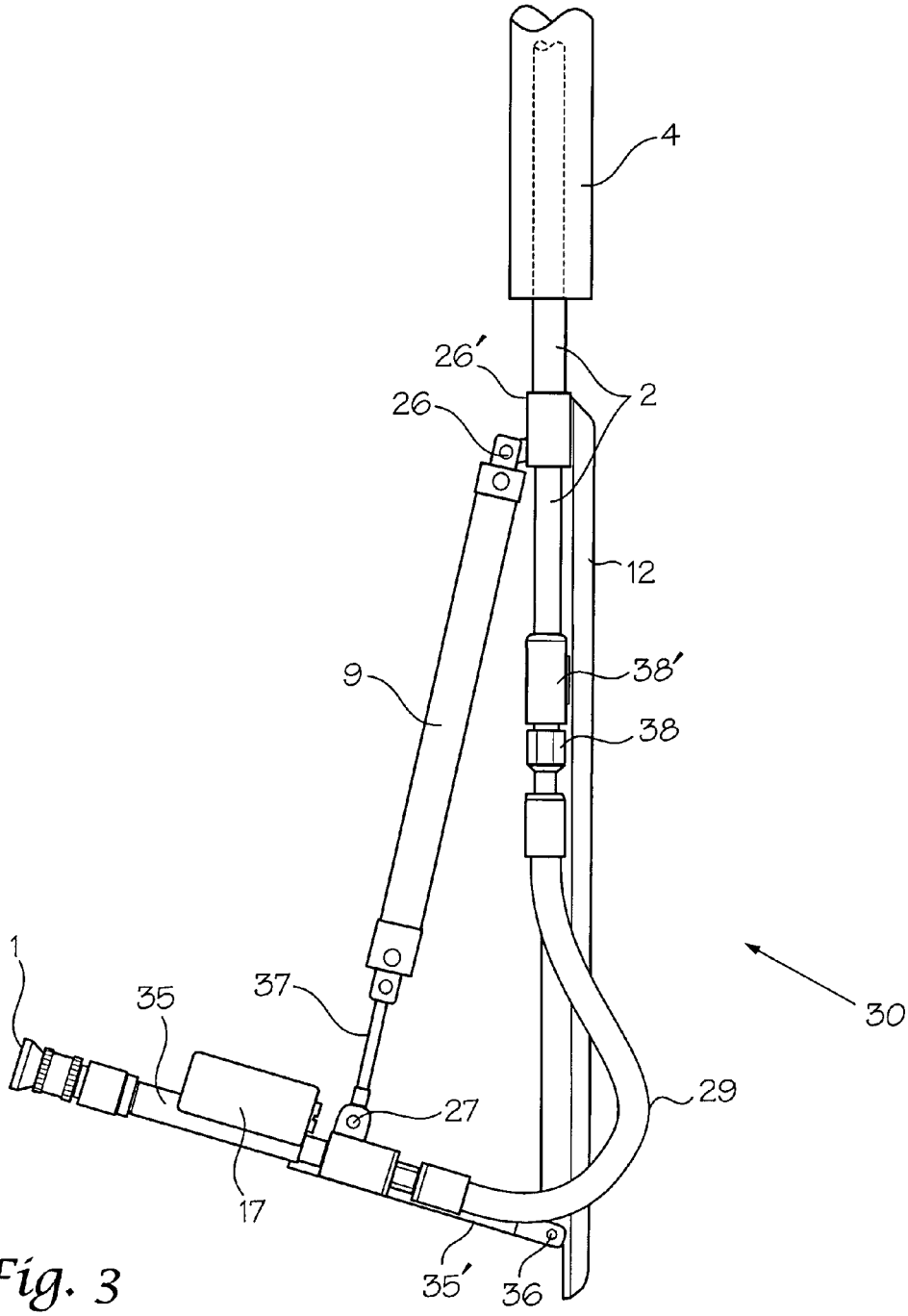
FIG. 3 is a lower section of the directed spray mast shown in FIG. 2 showing the side of the mast where the flexible hose connector is located.

Turning to FIG. 3, a view of the spray nozzle assembly is seen from the side of the spray mast which illustrates the coupling arrangement of the connector hose and water supply pipe. This is the lower portion of the directed spray mast and this assembly comprises the pneumatic cylinder 9, with its connecting rod 37 and pivotal connector 27 to support tube 35 which carries spray nozzle 1 at its outer end and is secured to the lower portion of the mast support plate 12 at stabilizing pivot 36. This view shows the water supply pipe connection to the flexible high pressure hose coupling 29 where it connects the bottom of supply pipe 2 to the support tube 35. Support tube 35 is fastened to support arm 35' that carries the tube 35 in cooperation with the pivot connection 36. The connection between hose 29 and supply pipe 2 is made by connector nut 38 which is screwed into the bottom of extended water pipe 2. Support plate 12 is attached to and carried by pipe 2. Also associated with and carried by plate 12 is pivotal support assembly 26 for the pneumatic cylinder 9. Assembly 26 includes clamping collar 26' to pipe 2 which also fastens to plate 12. The stabilizing or securing pivot 36 for support arm 35' and, hence, support tube 35 is anchored in the lower end of support plate 12. The pipe connector 38' associated with nut 38 is also attached to plate 12. This arrangement shortens the length required for high pressure connecting hose 29. Thus, minimum flexing is required for the elbow formed by the hose and minimum outward bending is required so that the slender, compact profile of the directed spray mast is accomplished. The hose, pneumatic lines, camera cable and housing are the only non-metallic parts so that there is a minimum of surface area on the directed spray mast to provide sites for containment collection. Cleaning is readily done, especially of the stainless steel. Thus, the mast itself presents minimal clean-up problems.

As mentioned, suitable pressure pumps for supplying pneumatic pressure to said supply lines with switches to control the flow of pressurized air are well known to those skilled in the art as is also camera cable connections to a video display to see the camera's view from within a vessel or tank. Cameras with low light capabilities are known in the art and a light source may also be associated with said camera to spot contaminated areas.

Cleaning chemicals may be added for more effective removal of debris and the pump can be pulsated or the nozzle configuration changed or adjusted for larger or smaller streams of spraying. Appropriate changes may be made in the hoses and pipe to accommodate higher pressures if such should be needed. However, the compact nature of the invention in which the support pipe, water supply pipe, support plate, and support tube are in substantial vertical alignment and are substantially parallel in direction, provides uses in numerous other cleaning functions where it is difficult to see the surface which needs to be cleaned. Persons skilled in the art upon reading the foregoing specification will realize the many advantages of this invention. While one preferred embodiment has been described herein the scope of this invention is not limited to this embodiment but is limited only by the claims which follow.

What is claimed is:

1. A directed spray mast for cleaning identified or selected surface areas in the interior of closed vessels, pipes, and the like through access ports of relatively small diameters comprising:

a) a multi-positionable, rotatable support pipe having upper and lower ends, said pipe having a substantially uniform diameter for insertion into an access port of a vessel to be cleaned;

b) lift bail means for supporting and vertically positioning said support pipe and for rotating same for radial positioning;

c) a water supply pipe positioned inside of and being substantially coaxial with said support pipe for supplying water, said water supply pipe extending above and below said support pipe and a water supply hose connected to a supply of water for delivering water to said supply pipe;

d) a support plate attached to and extending downwardly from the lower end of said water pipe;

e) a spray nozzle assembly pivotally mounted to said support plate adjacent said plate's lower end, said assembly extending linearly with and being parallel to said mast pipe in its compact or closed position;

f) a submersible, video camera mounted on said nozzle assembly;

g) pneumatic actuator means, said means being pivotally mounted on said supply pipe at said pipe's lower end with the other end of said actuator being pivotally attached to said nozzle assembly for raising and lowering the nozzle assembly in response to actuation of the pneumatic means whereby the nozzle assembly is caused to swing outwardly from said support plate to an expanded position of the spray mast and, with camera guidance, the nozzle assembly can be raised, lowered, and rotated to direct water spray to selected interior areas of vessel to be cleaned;

h) pneumatic lines operably connected to said pneumatic means, said line being disposed within said support pipe for a portion of their lengths and extending from said pneumatic means to the upper end of said mast pipe;

i) a cable line disposed within said mast pipe for a portion of its length and extending from said camera to said upper end of said support pipe; and j) swivel means associated with said lift bail means for receiving said pneumatic and cable lines to permit rotation of said mast without crimping or extangling said lines.

2. The directed spray mast of claim 1 wherein the spray nozzle assembly further comprises a spray nozzle and a support tube, said nozzle being supported by and operably connected to one end of said support tube, said support tube being pivotally attached at its other end to said support plate and intermediately pivotally attached to said pneumatic means.

3. The directed spray mast of claim 2 wherein the spray nozzle forms the lower end of said directed spray mast in the compact position of said mast.

4. The directed spray mast of claim 1 including flange means disposed around said support pipe adjacent its upper end, said flange means comprising a cover plate and gasket projecting outwardly a distance sufficient to cover the opening of vessel port into which said spray mast has been inserted to prevent spray from leaving the vessel.

5. A directed spray mast for cleaning identified or selected surface areas in the interior of closed vessels, pipes and the like through access port of relatively small diameter comprising:

a) a substantially straight water supply pipe suitable for being disposed vertically or horizontally and having upper and lower ends;

b) an elongated support plate having upper and lower ends, the upper end of said support plate being attached to the lower end of the supply pipe, said plate extending downwardly substantially in vertical alignment with said supply pipe;

c) a support tube pivotally connected to the lower end of said support plate, said tube extending downwardly in its compact or unexpanded portion whereby said supply pipe, support plate, and support tube are substantially vertically aligned;

d) a high pressure, flexible hose connected at one end to the support tube; and e) a connecting support nut attached to the other end of said hose for connecting the hose to the lower end of said water supply pipe;

f) a pneumatic actuator having an upper closed end and a lower end from which a connecting rod extends, said actuator being attached at its upper end to the lower end of said supply pipe and said connecting rod being attached pivotally to an intermediate position on said support tube; whereby when said connecting rod is withdrawn said support tube will pivot upwardly to an expanded position of said spray mast;

g) a spray nozzle at the lower end of said support tube for spraying a concentrated stream of high pressure water that is supplied to said nozzle through said hose and supply pipe; and h) a camera mounted on said support tube;

i) pneumatic supply lines for connecting said actuator to a source of pressurized air and a cable for connecting said camera to a video display screen;

j) a support pipe enclosing the upper portion of said water supply pipe, said pneumatic lines and said cable being threaded through the space between the supply tube and the support pipe; and k) lift bail means at the upper end of said supply pipe providing an exit for said cable and pneumatic lines and for raising, lowering and rotating the water supply pipe and the support tube carrying said nozzle as required in response to the video display provided by said camera.

* * * * *